US008985886B1

(12) United States Patent
Derrick

(10) Patent No.: US 8,985,886 B1
(45) Date of Patent: Mar. 24, 2015

(54) SHOWER WAND WITH SCRUB BRUSH

(71) Applicant: Rocky A. Derrick, Westminster, CO (US)

(72) Inventor: Rocky A. Derrick, Westminster, CO (US)

( * ) Notice: Subject to any disclaimer, the term of this patent is extended or adjusted under 35 U.S.C. 154(b) by 347 days.

(21) Appl. No.: 13/690,703

(22) Filed: Nov. 30, 2012

(51) Int. Cl.
*A46B 11/06* (2006.01)
*A46B 15/00* (2006.01)
*B05B 1/18* (2006.01)

(52) U.S. Cl.
CPC .. *A46B 15/00* (2013.01); *B05B 1/18* (2013.01)
USPC ..... 401/289; 4/606

(58) Field of Classification Search
CPC ..... B05B 1/18
USPC ..... 401/289, 123; 4/606; 15/28, 29, 34, 35, 15/50.1, 52, 52.1, 87, 104.09, 250.22
See application file for complete search history.

(56) References Cited

U.S. PATENT DOCUMENTS

| | | | | |
|---|---|---|---|---|
| 4,509,221 | A * | 4/1985 | Simpson, Jr. | 15/29 |
| 4,933,999 | A | 6/1990 | Mikiya et al. | |
| D334,049 | S | 3/1993 | Klose | |
| 5,246,301 | A | 9/1993 | Hirasawa | |
| D369,026 | S | 4/1996 | Furbert et al. | |
| 7,237,277 | B1 * | 7/2007 | Tsai et al. | 4/615 |
| 7,988,070 | B1 | 8/2011 | Yang et al. | |
| 8,342,768 | B1 * | 1/2013 | Johnston et al. | 401/289 |

* cited by examiner

*Primary Examiner* — Kevin Shaver
*Assistant Examiner* — Jennifer C Chiang
(74) *Attorney, Agent, or Firm* — Robert C. Montgomery; Montgomery Patent & Design

(57) ABSTRACT

A hand-held shower head with an integral deployable brush for cleaning one's back and other hard-to-reach body areas is mounted to the shower head handle upon a sliding mechanism. In a lowered position, the brush is out of the way of the water stream enabling operation similar to a conventional hand-held shower. When in a raised position, the water stream flows through openings in the brush body.

20 Claims, 4 Drawing Sheets

SHOWER WAND WITH SCRUB BRUSH

RELATED APPLICATIONS

There are no current co-pending applications.

FIELD OF THE INVENTION

The presently disclosed subject matter is directed toward shower accessories. More particularly, the present invention relates to a handheld shower scrubber for those hard-to-reach areas of the body.

BACKGROUND OF THE INVENTION

Bathing is an important function in today's society. People bathe or shower on a daily basis to become clean, eliminate body odor, and remove dirt. It can be very unpleasant to work with someone that has not bathed or showered for some time.

Today, most people tend to shower instead of taking a bath in a tub. The use of a shower instead of a tub saves time and water and can take up less space. Many people are rushed in the morning so getting ready for work, school, and social obligations means one often doesn't have adequate time to fill a tub, bath, and towel dry, and then get ready for their day. Therefore a shower is often more convenient. There is no need to fill a shower with water, which saves time, water, and thus money.

While some showers are very large, some are also small and very cramped. Therefore in many showers a handheld wand is not only useful it is a necessity. As useful or necessary as a shower wand is it still does not solve the age-old problems associated with washing the very hard-reach-areas of the body. While long-handled scrub brushes have been used they often do not enable adequate rinsing, they take storage space, and they can take significant time to use.

Accordingly, there exists a need a device by which a person can scrub and rinse those hard-to-reach body areas without the disadvantages described above. Beneficially such a device would be easy to use and low in cost. Preferably such a device would take the form of a shower wand, would incorporate a selectively used scrub brush, would provide for thorough rinsing, and would be useful for cleaning those hard to reach areas.

SUMMARY OF THE INVENTION

The principles of the present invention provide for a shower wand with scrub brush for scrubbing and rinsing hard-to-reach body areas. Beneficially the shower wand with scrub brush is easy to use, low in cost, takes the form of a shower wand, and incorporates a selectively used scrub brush.

A shower wand with scrub brush that is in accord with the present invention includes an elongated hollow handle having a shower head with a face on one (1) end and a water input on another end. The face includes water apertures for dispensing input water. The handle further includes an elongated slot and a locking feature at an upper end of said slot. The shower wand with scrub brush further includes a brush having a scrubbing feature and an integral arm with a protrusion. The integral arm is configured to slide along the slot and the protrusion is configured to fit into the lock feature. When the protrusion fits into the locking feature the scrubbing feature is in position over the face.

Beneficially the water input is threaded with external threads and a hose is threaded onto the water input. Also beneficially the locking feature locks the brush in an in-use position and prevents the brush from sliding along the slot until the locking feature is unlocked. In practice it is best if the scrubbing feature fits over the face such that the water apertures pass water through the scrubbing feature. Preferably the scrubbing feature includes a porous scrubbing surface.

The shower wand with scrub brush may further includes holder having an input spigot adaptor for receiving water from an existing spigot and a hose adaptor in fluid communication with the input spigot for passing received water into the hose. The holder may further include a handle opening for receiving and holding the handle and a valve for controlling water flow between the input spigot adaptor and the hose adaptor. Beneficially, the valve is a rotating ball valve having an angle that is controlled by an actuator.

An alternative shower wand with scrub brush that is in accord with the present invention includes an elongated hollow handle having a shower head with a face on one (1) end and a water input on another end. The face includes water apertures for dispensing input water. The handle further includes a pair of opposed elongated slots and that each ends in a locking feature. The alternative shower wand with scrub brush further includes a brush having a scrubbing feature and a pair of integral arms, each having a protrusion, that extend from the scrubbing feature. Each integral arm is retained in and slides along an associate elongated slot. Each protrusion fits into an associated locking feature when the scrubbing feature is over the face, and when a protrusion fits into a locking feature the brush is locked into position.

Beneficially, the alternative shower wand with scrub brush includes a hose that is threaded onto the water input. Also beneficially, when the scrubbing feature fits over the face water passing through the water apertures pass through the scrubbing feature. Preferably the scrubbing feature includes a porous scrubbing surface.

The alternative shower wand with scrub brush may further include a holder having an input spigot adaptor for receiving water from an existing spigot and a hose adaptor in fluid communication with the input spigot for passing received water into the hose. The holder may further include a handle opening for receiving and holding the handle. The holder beneficially includes a valve for controlling water flow between the input spigot adaptor and the hose adaptor. Preferably that valve is a rotating ball valve having an angle controlled by an actuator.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
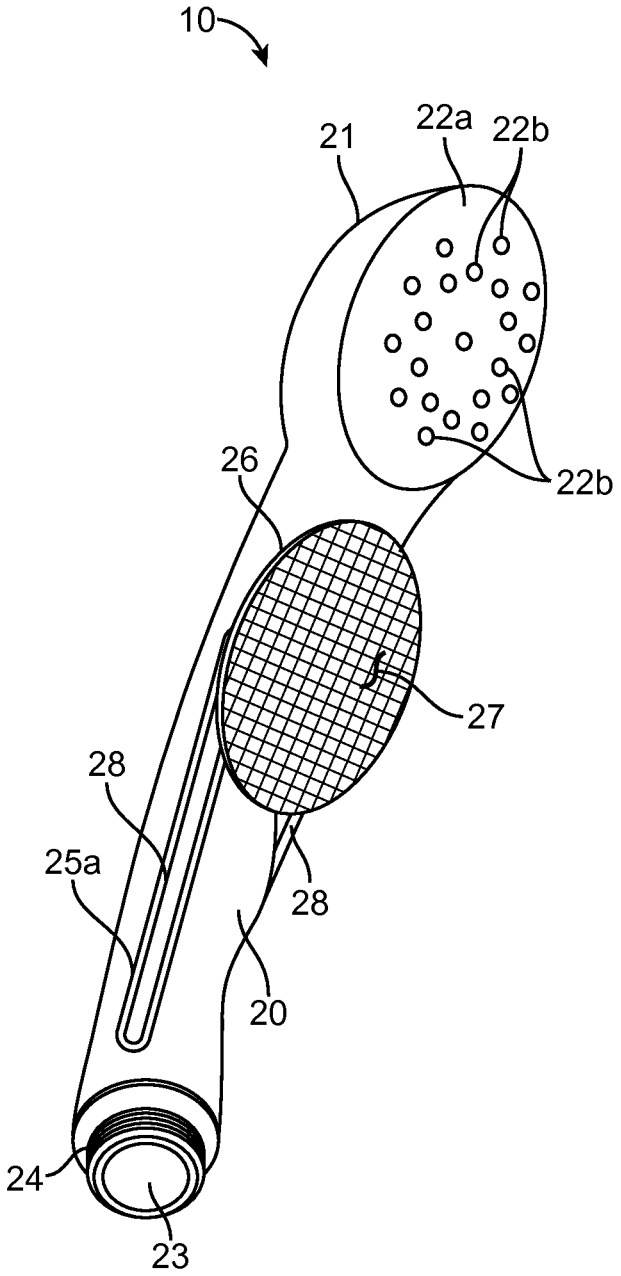
FIG. 1 is a perspective view of a shower wand with scrub brush 10 that is in accord with a preferred embodiment of the present invention.

10 shower wand with scrub brush
20 handle

21 head
22*a* face
22*b* water aperture
23 input opening
24 exterior threads
25*a* slot
25*b* locking feature
26 brush
27 scrubbing surface
28 arm
29 protrusion holder
31 hose adapter
32 spigot adapter
33 handle opening
34 actuator
35 ball valve
40 hose
41 holder fitting
42 handle fitting

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
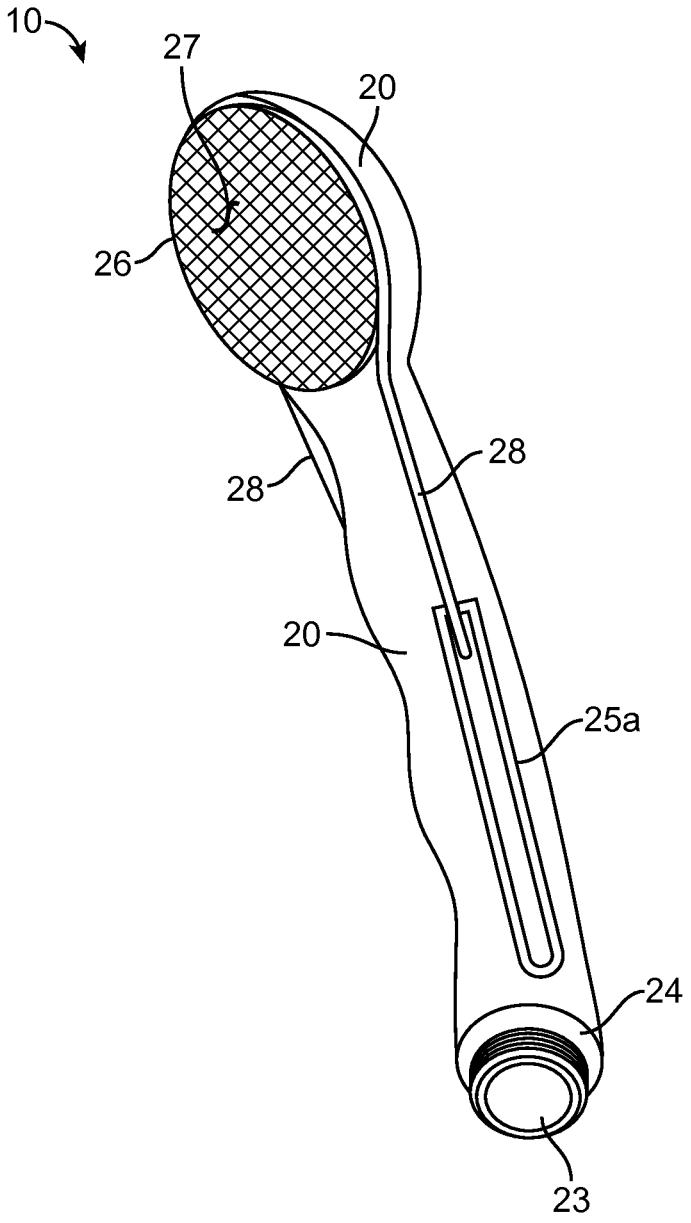
FIG. 2 is another perspective view of the shower wand with scrub brush 10 shown in FIG. 1.
Figure 3:
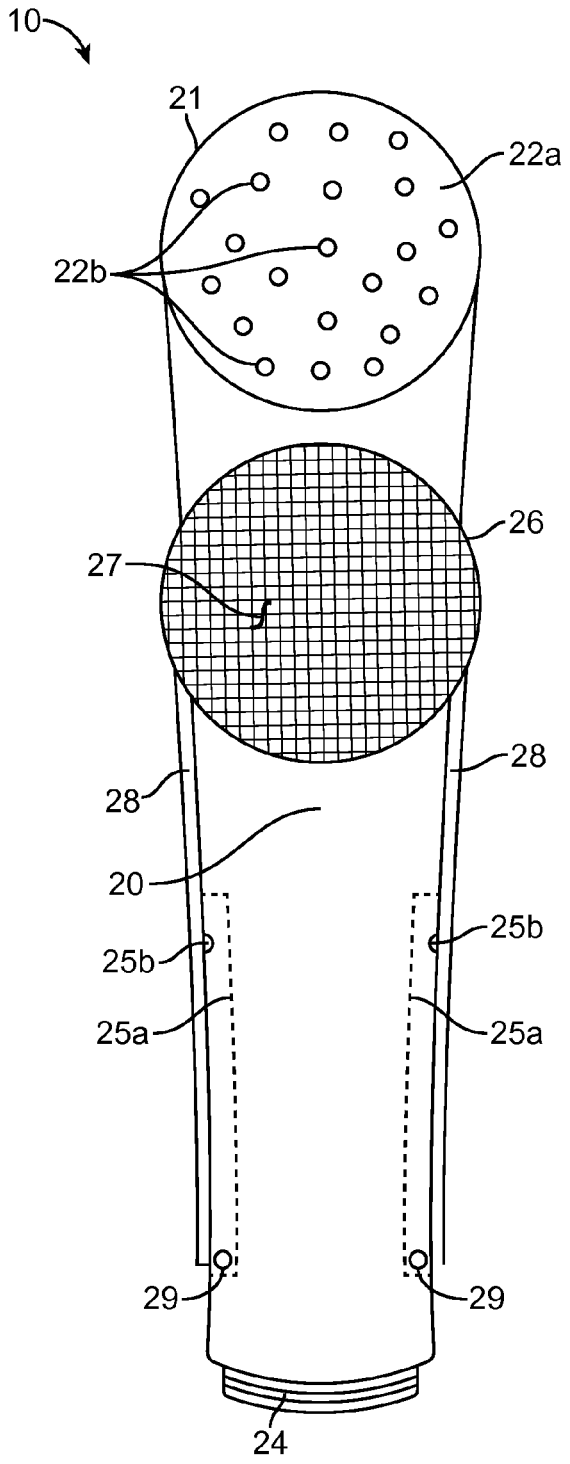
FIG. 3 is a front view of the shower wand with scrub brush 10 shown in FIGS. 1 and 2.

FIGS. 1, 2, and 3 illustrate a shower wand with scrub brush 10 that provides a scrubbing feature that enables thorough washing of oneself and which is in accord with the preferred embodiment of the present invention. FIGS. 1 and 2 show opposing perspective views of the shower wand with scrub brush 10 while FIG. 3 shows a front view. As shown, the shower wand with scrub brush 10 has an ergonomic, elongated, generally cylindrical handle 20 which extends from a bottom end having an input 23 upward to form an integral head 21. The handle 20 is hollow and can supply water to the head 21 when connected to a water source.

The head 21 has a generally oval-shape and includes a flat front face 22*a* having a plurality of water apertures 22*b*. The water apertures 22*b* enable water to be dispensed onto desired areas of a person showering. The bottom end of the handle 20 has the input 23 for receiving water that is to be routed to the head 21. The input 23 takes the form of a connector with exterior threads 24 that enable attachment of the handle 20 to a hose 40 (described in more detail below and reference FIG. 5).

The handle 20 includes a pair of elongated slots 25*a* that extend along the sides of the handle 20 and which are used to selectively slide a brush 26 up the handle 20. At the upper ends of the slots 25*a* are locking features 25*b* that lock the brush 26 in an in-use position (described in more detail subsequently) by preventing the brush 26 from descending until a user actively releases the brush 26. The in-use position has the brush 26 directly over the face 22*a* and water apertures 22*b*.

The brush 26 adds a scrubbing element to the shower wand with scrub brush 10. The brush 26 has a generally circular-shape that matches that of the face 22*a*. This enables the brush 26 to completely cover the face 22*a* when in the in-use position. The brush 26 has a scrubbing surface 27 fabricated from porous materials such as, but not limited to: loofah, wood fibers, or the like. The scrubbing surface 27 enables water from the face 22*a* and water apertures 22*b* to pass through the brush 26. The sides of the brush 26 extend into integral opposed arms 28 that slide along the elongated slots 25. At the end of each arm is a protrusion 29 that selectively fits into a locking feature 25*b*. This locks the brush 26 in position over the face 22*a* until a user removes the protrusions 29 from the locking features 25*b* which enables the brush 26 to move away from the face 22*a*.

Figure 4:
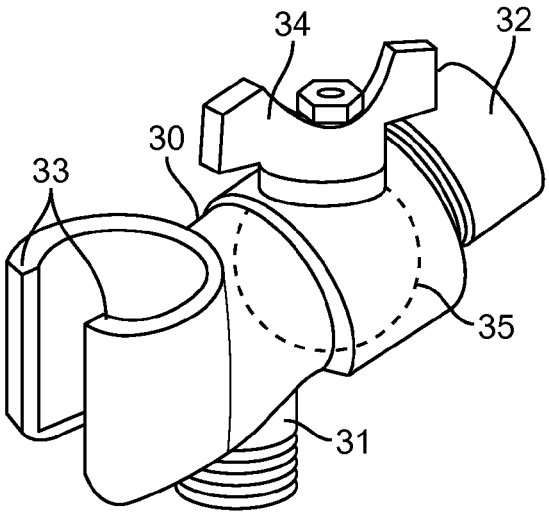
FIG. 4 is a perspective view of a holder 30 used in the shower wand with scrub brush 10 shown in FIGS. 1 through 3; and, FIG. 5 is a perspective view of a hose 40 used in the shower wand with scrub brush 10 shown in FIGS. 1 through 3.

FIG. 4 shows a perspective view of a holder 30 that is used to attach the shower wand with scrub brush 10 to existing plumbing. The holder 30 is fabricated from various rust-proof materials and may have a variety of finishes for use with various decors. The holder 30 includes a threaded hose adapter 31, a threaded spigot adapter 32, a handle opening 33, and an actuator 34. The spigot adapter 32 threads onto an existing spigot (not shown) to receiving incoming water while the hose adapter 31 enables attachment of the hose 40 which has threaded ends. That hose 40 is described in more detail subsequently. The handle opening 33 is used to suspend the handle 20 while the actuator 34 is used to control the flow of water between the spigot adaptor 32 and the hose adaptor 31.

The actuator 34 operably controls the rotation of an inner ball valve 35. The rotational position of the ball valve 35 controls the flow of water through the holder 30 and thus through the handle 20. As do most ball valves the ball valve 35 regulates the flow of water through internal apertures (not shown) by changing the angle of a ball aperture relative to pipe apertures. When the actuator 34 is manipulated to align the ball aperture with the pipe apertures maximum flow occurs, but when the ball aperture no longer aligns water flow is restricted.

The handle opening 33 is comprised of a generally "U"-shaped feature for suspending the handle 20 in an upright position with the head 21 oriented toward a user. The handle 20 is held in position when the handle opening cups the handle 20 from the holder 30. This configuration enables easy removal of the handle 20 from the handle opening 33.

Figure 5:
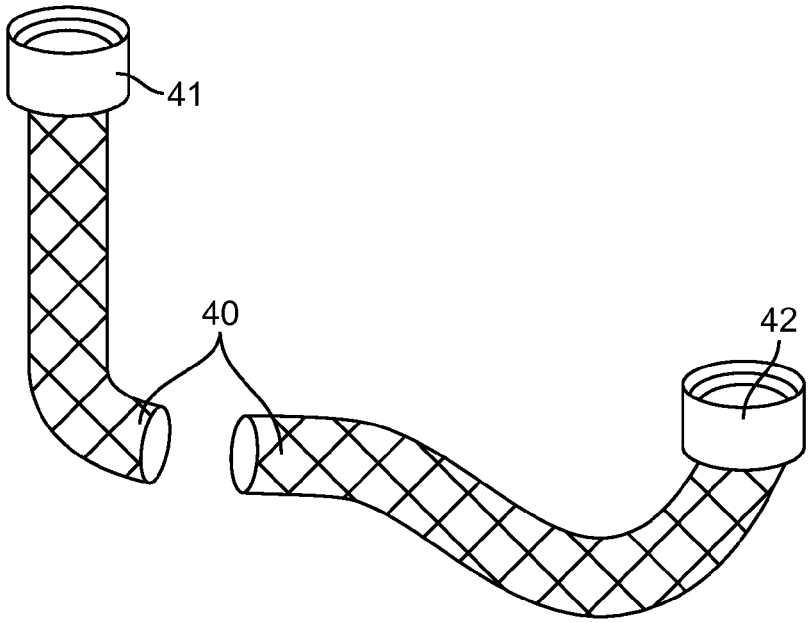

FIG. 5 presents a perspective view of the hose 40. Connecting the hose 40 to the hose adapter 31 directs water into the handle 20 and then to the head 21. The hose 40 is beneficially a hollow tube fabricated from materials such as, but not limited to: nylon, rubber, or the like. The hose 40 can be made available in various lengths to accommodate the needs of the user. One (1) end of the hose 40 has a holder fitting 41 which threads onto the hose adapter 31 while the other end has a handle fitting 42 which threads onto the exterior threads 24 of the handle 20.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be used by a common user in a simple and effortless manner with little or no training. After initial purchase or acquisition of the shower wand with scrub brush 10 it would be installed by attaching the spigot adapter 32 onto an existing spigot; orientating the actuator 34 to close the ball valve 35; attaching the holder fitting 41 of the hose 40 to the hose adapter 31 of the holder 30; attaching the handle fitting 42 of the hose 40 to the handle 20 via the exterior threads 24; inserting the handle 20 into the handle opening 33 on the holder 30 as desired; using the shower wand with scrub brush 10 as desired via activating water flow into the shower wand with scrub brush 10 via manipulating the actuator 34 to open the ball valve 35, thereby routing the water out of the water apertures 22*b*; extending the brush 26 as desired via moving the protrusions 29 of the arms 28 to mate with the locking feature 25*b* to lock the brush 26 in position; removing the handle 20 from the holder 30 and scrubbing a desired area; utilizing the shower wand with scrub brush 10 as desired; and providing for bathing in a shower in a manner which is quick, easy, and effective for all.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A shower wand with scrub brush, comprising:

an elongated hollow handle having a shower head with a face on one end and a water input on another end, said face having water apertures for dispensing input water, an elongated slot extending along said handle, and a locking feature at an upper end of said slot; and, a brush having a scrubbing feature and an integral arm with a protrusion, said integral arm configured to slide along said slot and said protrusion configured to fit into said lock feature;

wherein when said protrusion fits into said locking feature said scrubbing feature is over said face.

2. The shower wand with scrub brush according to claim 1, wherein said water input is threaded.

3. The shower wand with scrub brush according to claim 2, wherein said threads are external threads.

4. The shower wand with scrub brush according to claim 1, further including a hose threaded onto said water input.

5. The shower wand with scrub brush according to claim 1, wherein said locking feature locks said brush in an in-use position.

6. The shower wand with scrub brush according to claim 5, wherein said locking feature prevents said brush from sliding along said slot until said locking feature is unlocked.

7. The shower wand with scrub brush according to claim 1, wherein said scrubbing feature fits over said face, and wherein water passing through said water apertures can pass through said scrubbing feature.

8. The shower wand with scrub brush according to claim 7, wherein said scrubbing feature includes a porous scrubbing surface.

9. The shower wand with scrub brush according to claim 4, further including a holder having an input spigot adaptor for receiving water from an existing spigot and a hose adaptor in fluid communication with said input spigot for passing received water into said hose.

10. The shower wand with scrub brush according to claim 9, wherein said holder further includes a handle opening for receiving and holding said handle.

11. The shower wand with scrub brush according to claim 10, wherein said holder further includes a valve for controlling water flow between said input spigot adaptor and said hose adaptor.

12. The shower wand with scrub brush according to claim 11, wherein said valve is a rotating ball valve having an angle controlled by an actuator.

13. A shower wand with scrub brush, comprising:

an elongated hollow handle having a shower head with a face on one end and a water input on another end, said face having water apertures for dispensing input water, said handle further includes a pair of elongated slots that extend along opposite sides of said handle, wherein each elongated slot ends in a locking feature;

a brush having a scrubbing feature and a pair of integral arms that extend from said scrubbing feature, each integral arm having a protrusion;

wherein each integral arm is retained in and slides along an associate elongated slot of said pair of elongated slots;

wherein a protrusion fits into an associated locking feature when said scrubbing feature is over said face; and, wherein when a protrusion is in a locking feature said brush is locked into position.

14. The shower wand with scrub brush according to claim 13, further including a hose threaded onto said water input.

15. The shower wand with scrub brush according to claim 14, wherein said scrubbing feature fits over said face, and wherein water passing through said water apertures can pass through said scrubbing feature.

16. The shower wand with scrub brush according to claim 15, wherein said scrubbing feature includes a porous scrubbing surface.

17. The shower wand with scrub brush according to claim 16, further including a holder having an input spigot adaptor for receiving water from an existing spigot and a hose adaptor in fluid communication with said input spigot for passing received water into said hose.

18. The shower wand with scrub brush according to claim 17, wherein said holder further includes a handle opening for receiving and holding said handle.

19. The shower wand with scrub brush according to claim 18, wherein said holder further includes a valve for controlling water flow between said input spigot adaptor and said hose adaptor.

20. The shower wand with scrub brush according to claim 19, wherein said valve is a rotating ball valve having an angle controlled by an actuator.

* * * * *